US012618255B2

(12) United States Patent
Hagen

(10) Patent No.: US 12,618,255 B2
(45) Date of Patent: May 5, 2026

(54) SEISMIC WALL FUSE

(71) Applicant: DEGENKOLB ENGINEERS, San Francisco, CA (US)

(72) Inventor: Garrett R. Hagen, Dana Point, CA (US)

(73) Assignee: DEGENKOLB ENGINEERS, San Francisco, CA (US)

( * ) Notice: Subject to any disclaimer, the term of this patent is extended or adjusted under 35 U.S.C. 154(b) by 147 days.

(21) Appl. No.: 18/598,471

(22) Filed: Mar. 7, 2024

(65) Prior Publication Data

US 2025/0283343 A1 Sep. 11, 2025

(51) Int. Cl.

| | |
|---|---|
| ***E04H 9/14*** | (2006.01) |
| ***E04B 1/98*** | (2006.01) |
| ***E04H 9/02*** | (2006.01) |
| *E04B 1/24* | (2006.01) |

(52) U.S. Cl.

CPC ..... *E04H 9/021* (2013.01); *E04H 9/14* (2013.01); *E04B 1/2403* (2013.01); *E04B 1/98* (2013.01); *E04H 9/0237* (2020.05)

(58) Field of Classification Search

None

See application file for complete search history.

(56) References Cited

U.S. PATENT DOCUMENTS 2,064,910 A * 12/1936 Harper ..... E04C 3/293 52/262
2,271,929 A * 2/1942 Venzie ..... E04B 9/001 52/145
2,828,843 A * 4/1958 Hill ..... B21D 31/043 72/379.6
3,255,561 A * 6/1966 Cable ..... E04F 13/06 52/717.06
3,797,183 A * 3/1974 Kobayashi ..... E04C 5/06 52/378
3,869,778 A * 3/1975 Yancey ..... B21D 47/00 428/596
4,236,843 A * 12/1980 Chisholm ..... E01F 9/635 285/4

(Continued)

FOREIGN PATENT DOCUMENTS

CN 107338872 A * 11/2017 ..... E04G 21/14
CN 112252509 A * 1/2021 ..... E04B 1/98

(Continued)

*Primary Examiner* — Phi D A

(74) *Attorney, Agent, or Firm* — David R. Heckadon; Gordon Rees Scully Mansukhani LLP

(57) ABSTRACT

One or more seismic wall fuses that wrap around the edge of a building wall, the seismic wall fuses having a first wall panel on one side of the wall and a second wall panel on the other side of the wall, and an edge panel along the edge of the wall connected to the first and second wall panels. Each of the first and second wall panels have: a top portion that is attached to the wall, a mid portion that deforms to absorb seismic stresses, and a bottom portion that is also attached to the wall. In operation, the mid-portion of the first wall panel expands while the mid-portion of the second wall panel simultaneously contracts (or vice versa), thereby dissipating seismic energy in a direction perpendicular to the plane of the wall, which could otherwise topple the wall.

18 Claims, 6 Drawing Sheets

(56) References Cited

U.S. PATENT DOCUMENTS 4,926,592 A * 5/1990 Nehls ..... E01F 9/685 40/607.05
4,959,934 A 10/1990 Yamada et al.
5,335,463 A * 8/1994 Reinhall ..... E04B 1/98 52/167.1
5,533,307 A 7/1996 Tsai et al.
5,706,626 A * 1/1998 Mueller ..... E04H 9/0237 52/656.2
5,896,716 A * 4/1999 Jalla ..... E04G 23/0218 52/712
5,901,525 A * 5/1999 Doeringer ..... E04H 12/2253 52/298
6,003,276 A * 12/1999 Hegemier ..... E04H 9/021 52/273
6,047,510 A * 4/2000 Gallaway ..... E04F 13/04 52/354
6,158,184 A * 12/2000 Timmerman, Sr. ... E04B 1/2608 52/712
6,210,066 B1 * 4/2001 Dent ..... E01F 9/635 248/548
6,264,162 B1 * 7/2001 Barnes ..... E01F 9/638 248/548
6,725,615 B1 * 4/2004 Porter ..... A62C 2/065 52/99
6,799,400 B2 * 10/2004 Chuang ..... F16F 7/12 188/371
7,513,083 B2 * 4/2009 Pryor ..... E02D 27/42 52/298
7,712,266 B2 5/2010 Sarkisian
7,921,537 B2 * 4/2011 Rodlin ..... E04F 13/068 29/458
8,117,788 B1 * 2/2012 Mueller ..... E04H 9/0237 52/573.1
8,234,836 B2 * 8/2012 Anderson ..... E04C 3/09 52/843
8,302,351 B2 * 11/2012 Ohashi ..... E04H 9/0237 52/167.3
8,397,444 B2 3/2013 Reaveley et al.
8,511,025 B2 8/2013 Kawai et al.
8,590,220 B2 11/2013 Ozaki et al.
8,683,758 B2 4/2014 Christopoulos et al.
8,720,154 B1 * 5/2014 Horne ..... E04B 7/045 52/262
8,875,452 B2 11/2014 Kawai et al.
8,881,491 B2 * 11/2014 Christopoulos ..... E04B 1/98 52/167.6
8,998,182 B2 4/2015 Kim et al.
9,051,733 B2 6/2015 Yamao et al.
9,915,078 B2 3/2018 Gray et al.
10,533,338 B2 1/2020 Blomgren et al.
10,563,418 B2 2/2020 Pall
10,689,876 B2 6/2020 Richards
10,787,832 B2 9/2020 Blomgren et al.
2005/0257451 A1 * 11/2005 Pryor ..... E04B 1/98 52/167.4
2006/0037256 A1 * 2/2006 Pryor ..... F16B 15/0046 52/167.1
2010/0319271 A1 * 12/2010 Sarraf ..... E01D 19/02 52/701
2011/0031080 A1 2/2011 Cahis I Carola
2012/0304587 A1 12/2012 Kenho
2013/0074427 A1 * 3/2013 Kawai ..... E04H 9/0237 188/371
2014/0182234 A1 * 7/2014 Yang ..... E04B 1/2403 52/655.1
2015/0096244 A1 * 4/2015 Richards ..... E04C 3/02 52/843
2022/0136237 A1 5/2022 Gandelli et al.
2022/0333369 A1 10/2022 Richards
2022/0333397 A1 10/2022 Richards

FOREIGN PATENT DOCUMENTS

CN 115478631 A * 12/2022 ..... E04B 1/98
CN 118345969 A * 7/2024 ..... E04G 21/00
CN 118498552 A * 8/2024 ..... E04H 9/021
CN 118498619 A * 8/2024 ..... E04H 9/021
CN 118517086 A * 8/2024 ..... E04H 9/021
JP 2015113703 A * 6/2015 ..... E01D 19/00
KR 20120074361 A * 7/2012 ..... E04H 9/021
KR 101655743 B1 * 9/2016 ..... E04B 1/98
WO WO-2011086770 A1 * 7/2011 ..... E04H 9/0237
WO WO-2019059576 A1 * 3/2019 ..... E04B 1/98

* cited by examiner

SEISMIC WALL FUSE

TECHNICAL FIELD

The present invention relates in general to structures for dissipating seismic energy in a building, and in particular to structures for dissipating seismic energy in a concrete building wall.

BACKGROUND OF THE INVENTION

A variety of seismic devices exist for reinforcing different building structures and for helping to dissipate earthquake energy in buildings. Such devices may include various yielding devices and/or various vibration damping devices. A seismic fuse is an example of such a yielding device. In short, a seismic fuse is a steel assembly that is positioned between the ends of two beam sections and deforms as the beam sections move with respect to one another. Typically, a seismic fuse is installed with its two beam sections being connected to opposite diagonal corners of the frame of a wall. As such, the seismic fuse provides seismic reinforcement in directions in the plane of the wall itself.

Although seismic fuses are very useful, they are limited in that they only dissipate seismic energy across the plane of a wall. What would instead be desirable is to provide a seismic wall fuse assembly that would instead dissipate seismic loading in a plane perpendicular to the wall itself (for example, when one side of the wall is under tension and the other side of the wall is under compression). As such, the desired seismic fuse would dissipate energy in directions that would otherwise tend to topple over the wall.

In addition, it would also be desirable to provide such a seismic fuse system that is both fast and relatively easy to assemble. It would also be desirable to provide such a new seismic wall fuse system that can be easily retrofit into existing building walls, and especially onto concrete walls connected to building foundations. As will be shown, the present invention provides such a system.

SUMMARY OF THE INVENTION

The present invention provides a seismic wall fuse that is easy to attach onto the side edge of a building wall (such as a concrete building wall) to provide seismic energy dissipation. A unique advantage of the present system is that it resists seismic loading perpendicular to the plane of the wall (e.g.: when one side of the wall is under compression and the other side of the wall is in tension). As such, the present system resists seismic energy in the direction of the wall "toppling over".

In preferred aspects, the present system provides a seismic wall fuse, comprising: a first wall panel and a second wall panel, wherein the first and second wall panels are positioned in parallel on opposite sides of an edge of the wall. Preferably, each of the first and second wall panels comprise: a top portion that is configured to be attached to the wall, a mid-portion that is configured to deform to absorb seismic stresses, and a bottom portion that is also configured to be attached to the wall. In operation, the mid-portion of the first wall panel deforms to expand while the mid-portion of the second wall panel simultaneously deforms to contract, and vice versa.

In various preferred aspects, the seismic wall fuse also includes an edge panel connected on one side to the first wall panel and on another side to the second wall panel. The edge panel is oriented perpendicular to the first and second wall panels such that the seismic wall fuse wraps around the edge of a wall.

In optional preferred embodiments, two or more of the present seismic wall fuses may be nested to wrap one around the other around the edge of the wall.

In further optional embodiments, a connection plate may be used to secure the seismic wall fuse to the building foundation. This connection plate may optionally be positioned in a nested configuration with one or more of the seismic wall fuses.

A unique advantage of the present system is that the same connectors that are to secure the first wall panel to one side of the wall may be used to secure the second wall panel to the opposite side of the wall. This may be achieved by having a plurality of wall connectors (such as bolts) passing through aligned holes in the first and second wall panels. In addition, the same connectors can be used to secure the seismic wall fuse to a base plate connected to the building foundation (thereby securing the seismic wall fuse to the building foundation while avoiding the need for additional connectors and fasteners).

The mid-portions of the wall panels deform (i.e.: expand or contract) to dissipate seismic energy. In preferred aspects, the mid-portions of each wall panel comprises a plurality of laterally extending slits. These slits may preferably be diamond shaped. The mid-portions of these wall panels may also have a plurality of slots that are cut inwardly from opposite sides of the wall panel. These slots are preferably cut into opposite sides of the wall panel to widen when the wall panel is stretched, and to narrow when the wall panel is compressed.

In optional preferred aspects, the present system may also include a plurality of foundation connectors and base plate connecting the bottom portions of the wall panels down into a concrete wall foundation. Optionally, shear keys in the bottom of the wall may also be used.

In further optional aspects, the present system may be stacked such that one seismic fuse may positioned overtop of another one, running up along the edge of the wall.

Yet another advantage of the present system is that it provides a system that uses few materials, and limited parts. It is therefore fast and easy to fabricate and to install.

Moreover, in addition to being useful with concrete walls, the present system may also be used with wood, masonry, cross-laminated timber, etc. It is to be understood, therefore, that the present system is not limited to use solely with concrete walls and structures.

BRIEF DESCRIPTION OF THE FIGURES

FIG. 7B also shows corresponding deformation of each of the seismic wall fuses at opposite ends of the wall.

DETAILED DESCRIPTION OF THE FIGURES

Figure 1:
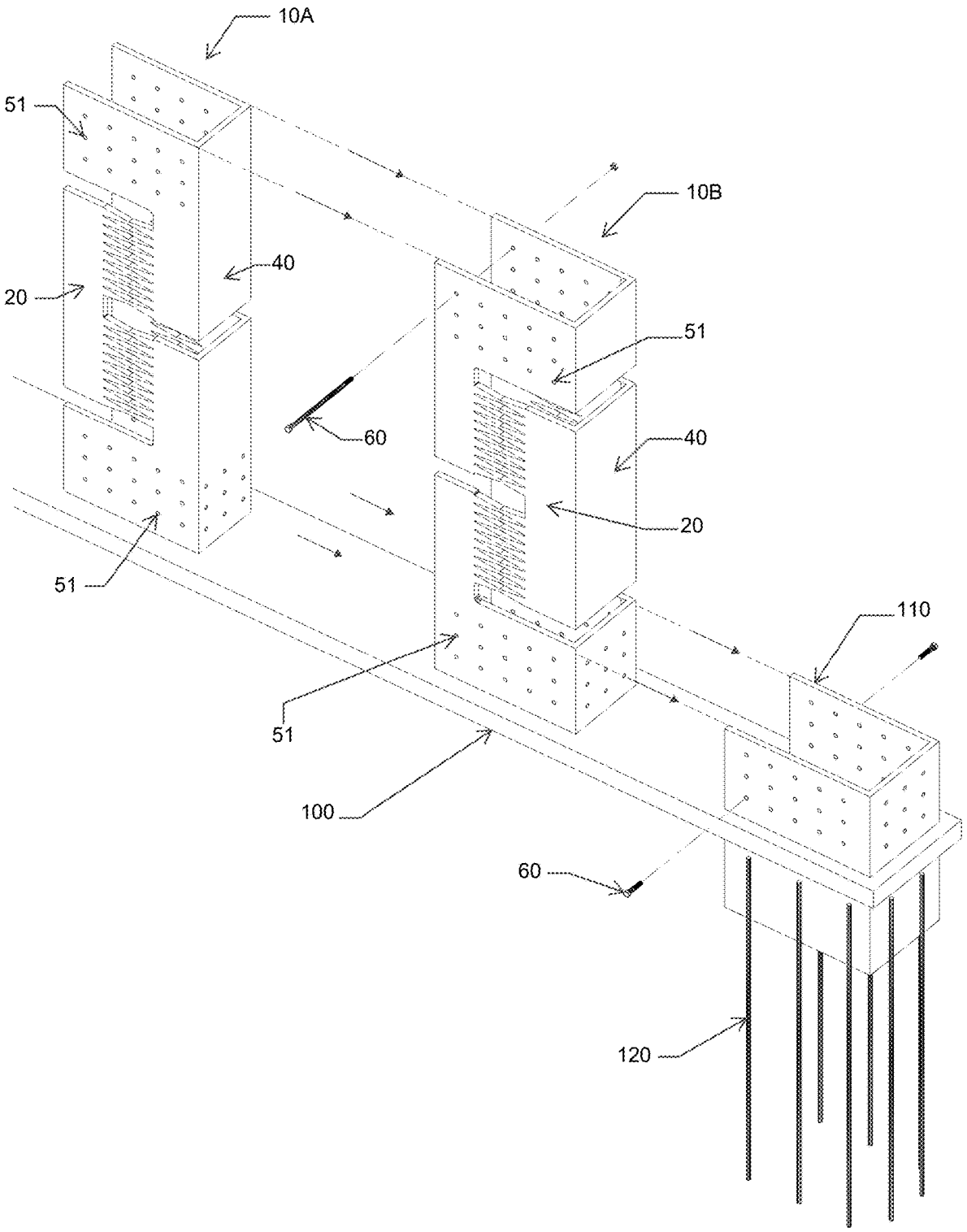
FIG. 1 is an exploded perspective view of a pair of the present seismic wall fuses being nested together with a connection plate on a base plate, with the wall itself removed for clarity of illustration.
Figure 2:
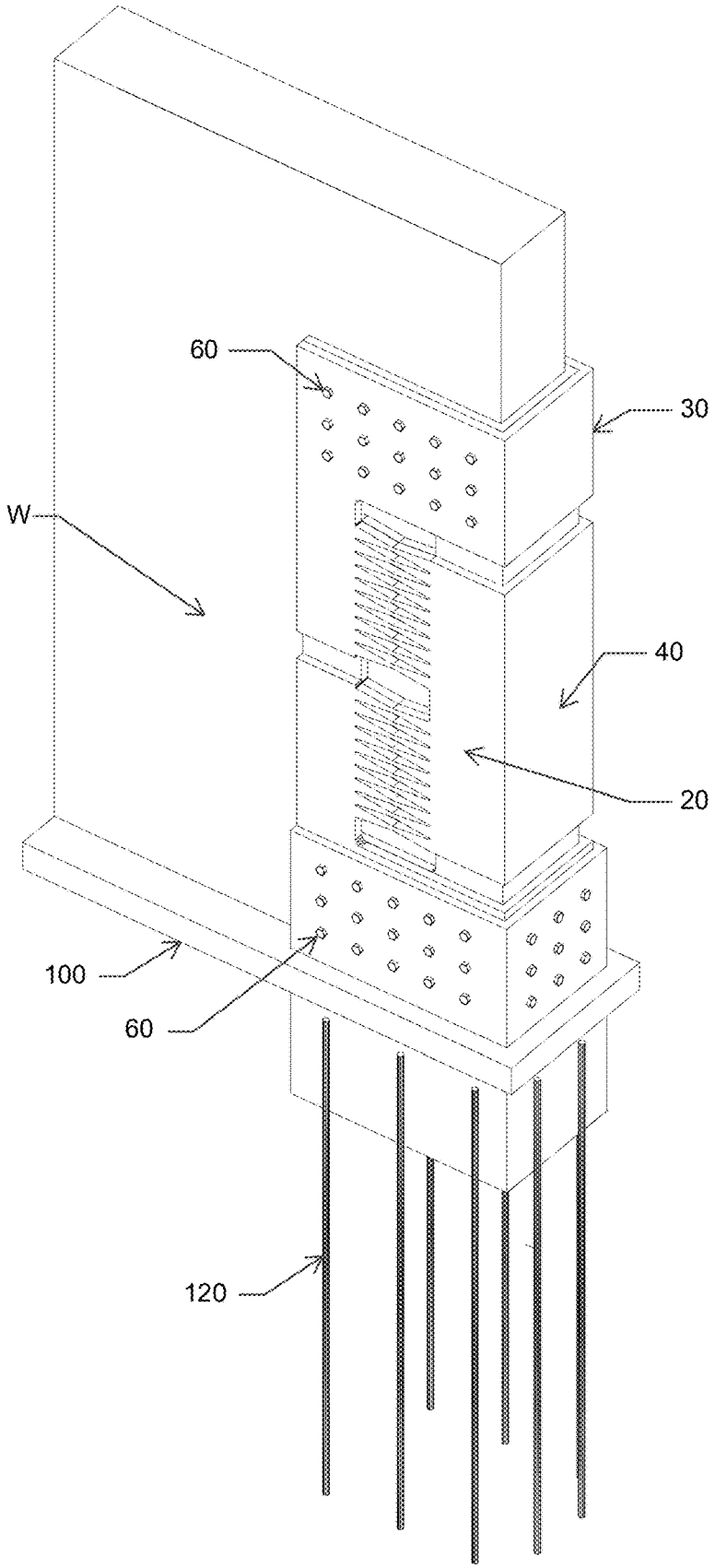
FIG. 2 is a view similar to FIG. 1, showing the connection plate and two of the present seismic wall fuses being nested together around the edge of a building wall, adding a portion of the wall itself.

The exploded view of FIG. 1 and the assembled view of FIG. 2 show a pair of seismic wall fuses 10A and 10B which are nested together, wrapping around the edge of a building wall. It is to be understood that the present system encompasses embodiments having only one seismic wall fuse 10, a pair of nested seismic wall fuses 10A and 10B, or optionally three or more seismic wall fuses nested together, as desired.

Figure 6A:
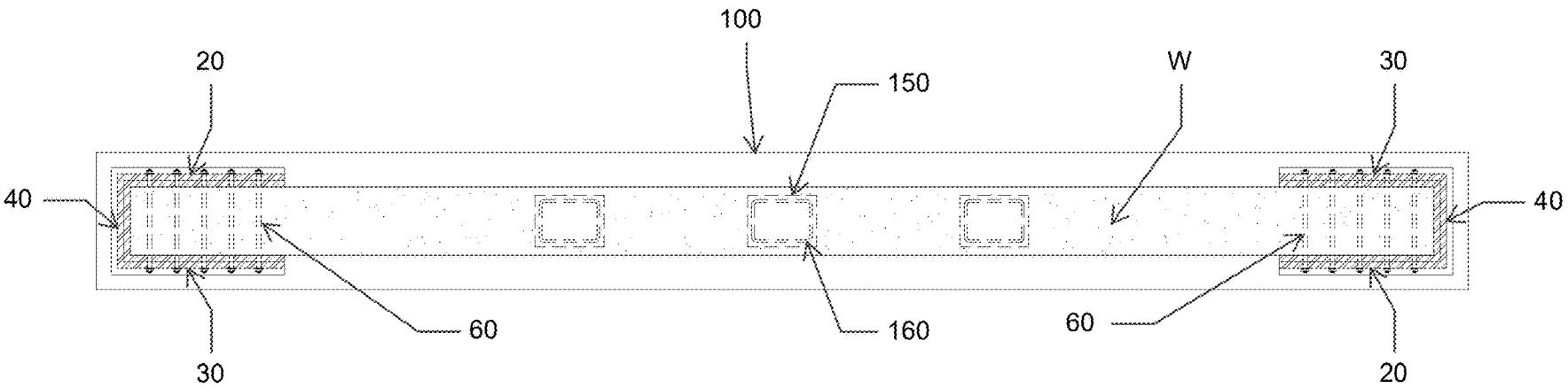
FIG. 6A is a top sectional plan view of a building wall showing the two of the present seismic wall fuses positioned at opposite ends of the building wall.
Figure 6B:
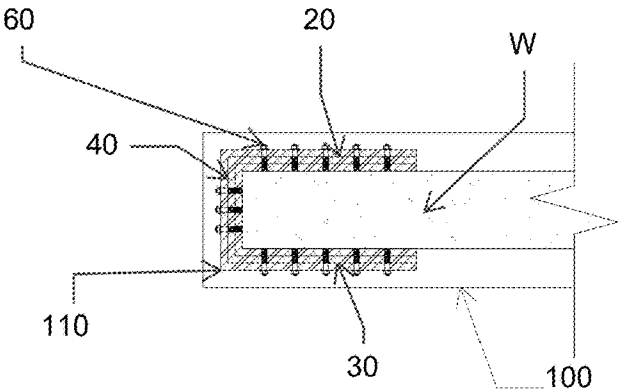
FIG. 6B is a close-up view similar to FIG. 6A, but showing only one of the present seismic wall fuses and its attachment to a connection and base plate.

As seen in the Figures, each wall fuse 10A and 10B preferably comprises a first wall panel 20 and a second wall panel 30. As seen in FIGS. 2, 6A and 6B, the first and second wall panels 20 and 30 are configured to be positioned in parallel on opposite sides of a wall W. As can also be seen in FIG. 2, the seismic wall fuses 10A and 10B both wrap around the edge of wall W (in addition to being nested one inside the other, as shown).

Figure 3A:
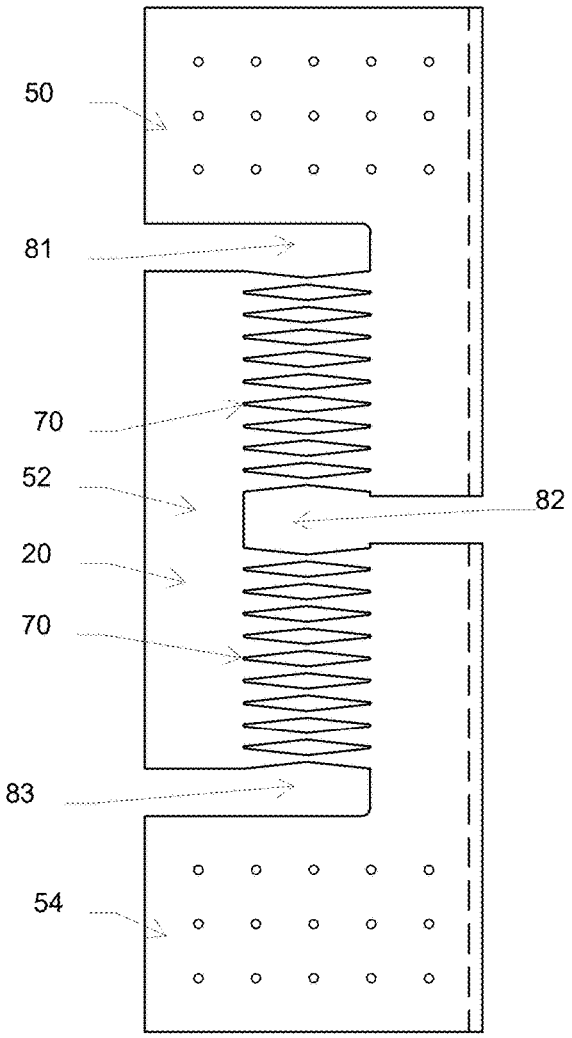
FIG. 3A is a rear elevation view of a wall panel in a non-stressed position.
Figure 3B:
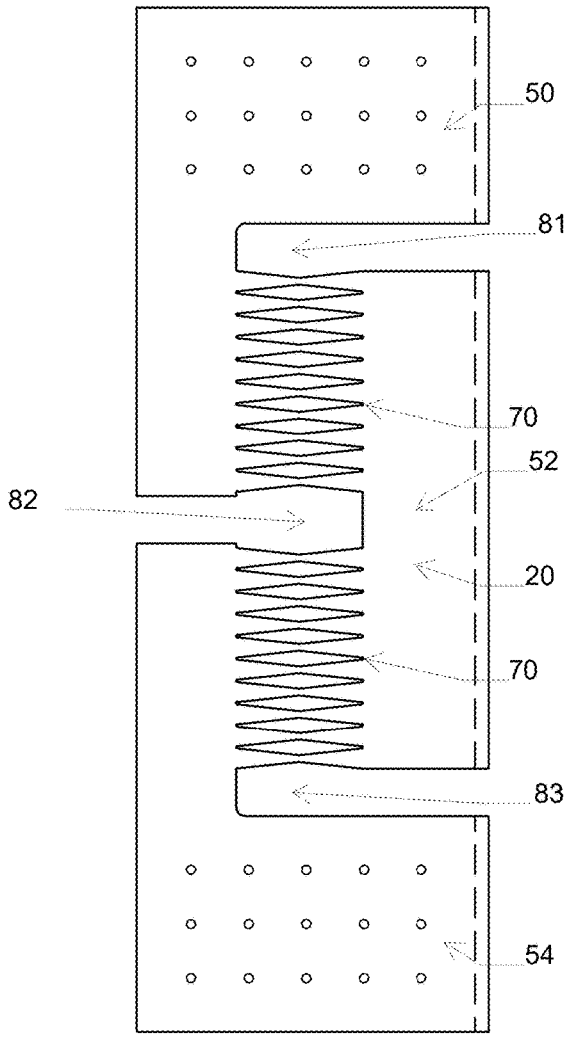
FIG. 3B is a front elevation view of the wall panel in a non-stressed position.

In preferred aspects as seen in FIGS. 3A and 3B, first wall panel 20 comprises:

- a top portion 50 that is configured to be attached to the wall,
- a-mid portion 52 that is configured to deform to absorb seismic stresses, and a bottom portion 54 that is configured to be attached to the wall.

Second wall panel 30 has a similar (e.g.: identical, but reversed/mirrored) shape to first wall panel 20. In operation, for example, when seismic loading perpendicular to the plane of wall W acts in a direction to topple the wall over, the mid-portion 52 of the first wall panel 20 deforms to expand while the mid-portion 52 of the second wall panel 30 simultaneously deforms to contract. Conversely, the mid-portion 52 of the first wall panel 20 deforms to contract while the mid-portion 52 of the second wall panel 30 simultaneously deforms to contract. As a result, the seismic loading is resisted by the present seismic fuse on both sides of wall W.

Figure 4:
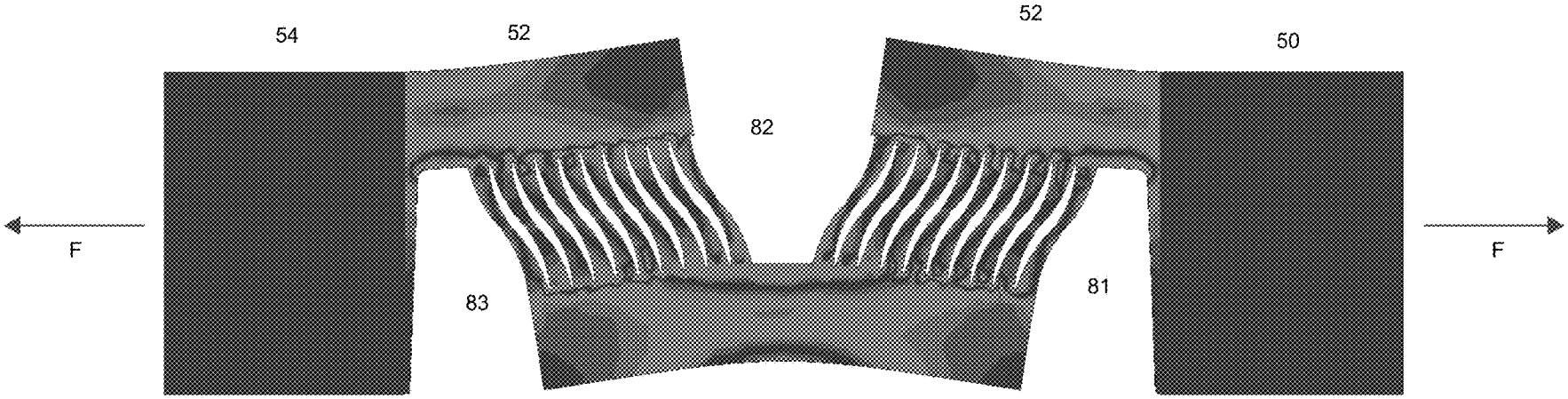
FIG. 4 is a front elevation view of the wall panel in an expanded state.
Figure 5:
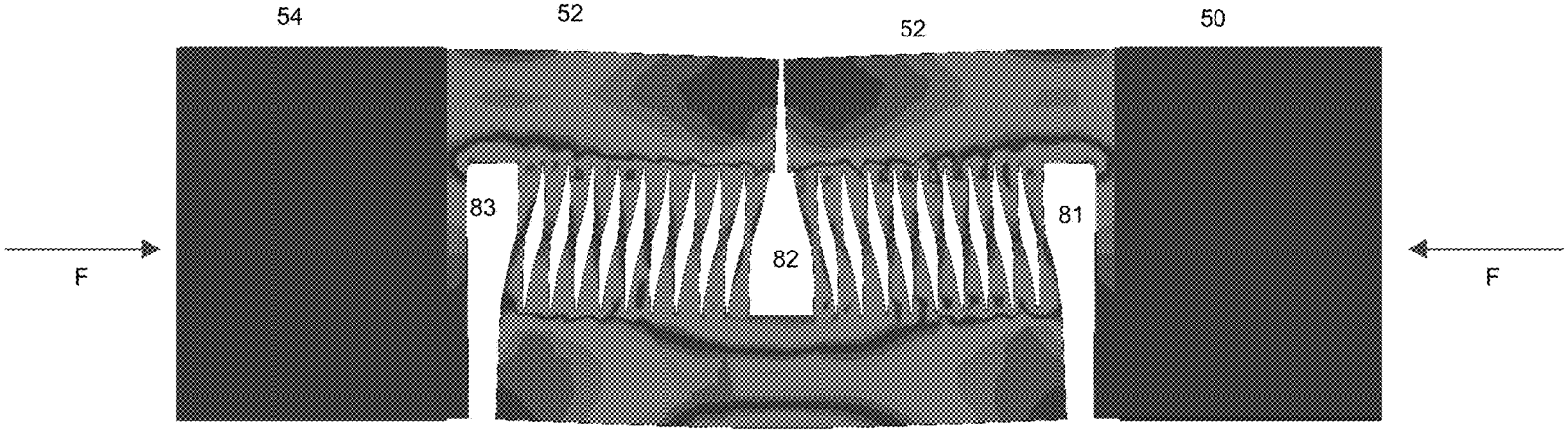
FIG. 5 is a front elevation view of the wall panel in a compressed state.

FIG. 4 shows an example of the wall panel 20 pulled by seismic forces F to expand whereas FIG. 5 shows an example of the wall panel 20 with seismic forces F compressing the panel. (Note: FIGS. 4 and 5 are somewhat exaggerated views to clearly illustrate the deformation in the present system).

In preferred aspects as seen in FIGS. 1 and 2, the first (i.e.: front) wall panel 20 and the second (i.e.: back) wall panel 30 are connected together by an edge panel 40 which is connected on one side to the first wall panel 20 and on another side to the second wall panel 30. As can best be seen best in FIGS. 6A and 6B, edge panel 40 is oriented perpendicular to the first and second wall panels 20 and 30 such that the seismic wall fuse 10 can be positioned to wrap around the edge of wall W as seen in FIG. 2.

In preferred aspects, a plurality of wall connectors 60 pass through the first and second wall panels 20 and 30 to connect the first and second wall panels to opposite sides of the wall. Preferably, each of the first and second wall panels 20 and 30 have apertures 51 passing therethrough, and the apertures 51 in each of the first and second wall panels 20 and 30 are preferably aligned such that the wall connectors 60 simply pass through the aligned apertures. Wall connectors 60 may be bolts or any other suitable form of connectors.

FIG. 1 also illustrates a base plate 100 and a connection plate assembly 110. Base plate 100 is positioned under wall W (FIG. 2), and seismic wall fuses 10A and 10B are nested inside connection plate assembly 110 (FIG. 2). The same wall connectors 60 can pass through apertures in the connection plate assembly 110, thereby using only a single bolt connector 60 to fasten seismic wall fuses 10 and 10B and connector plate assembly 110 together. Connector plate assembly 110 is secured to base plate 100 which is in turn secured to foundation anchors 120.

Further preferred details of the shape of wall panels 20 can be seen in FIGS. 3A and 3B. (Wall panel 30 is preferably a mirror image of wall panel 20). The mid-portions 52 of each wall panel may preferably include a plurality of laterally extending slits 70, which may optionally be diamond shaped. In addition, the mid-portions 52 of each wall panel 20 or 30 may comprise a plurality of slots 81, 82 and 83 cut inwardly from opposite sides of the wall panel.

As can be seen in FIG. 4, the wall panel deforms to absorb seismic stresses by widening slots 81, 82 and 83 when the wall panel is stretched, or as can be seen In FIG. 5, the wall panel deforms to absorb seismic stresses by narrowing the slots 81, 82 and 83 when the wall panel is compressed.

As can also be seen, slots 81, 82 and 83 can preferably be arranged such that:

- slot 81 separates the top portion 50 and the mid-portion 52 of the wall panel;
- slot 82 separates upper and lower regions of the mid-portion 52 of the wall panel; and
- slot 83 separates the mid-portion 52 and the bottom portion 54 of the wall panel.

As illustrated, slots 81 and 83 are cut inwardly from one side, whereas slot 82 is cut inwardly from the opposite direction.

It is to be understood that the illustration of slits 70 and slots 81 to 83 are merely exemplary and that the present invention is not limited to this specific illustrated embodiment. As such, other patterns of slots and slits are also encompassed within the scope of the present invention.

FIGS. 6A and 6B illustrate top sectional plan views of a pair of the present seismic wall fuses wrapping around the edges of a wall W. The passage of connector bolts 60 through wall W and through wall panels 20 and 30 and through connector plate assembly 110 can be seen.

FIG. 6A further illustrates an optional shear key 150 in wall W and base plate 100 may have a member (which may be steel) 160 that is received up into the bottom of shear key 150. This shear key structure is also seen in FIGS. 7A and 7B described below.

Figure 7B:
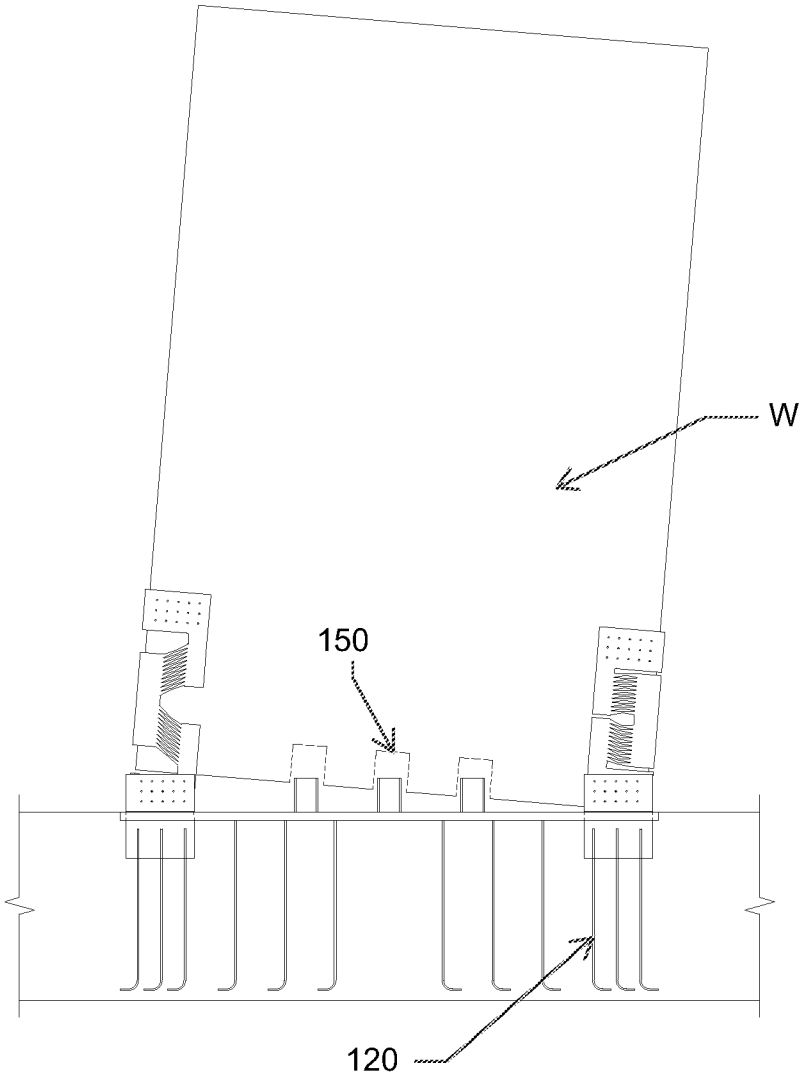
FIG. 7B is similar to FIG. 7A, but shows movement of the wall in a shear direction (i.e.: parallel to the plane of the wall).
Figure 7A:
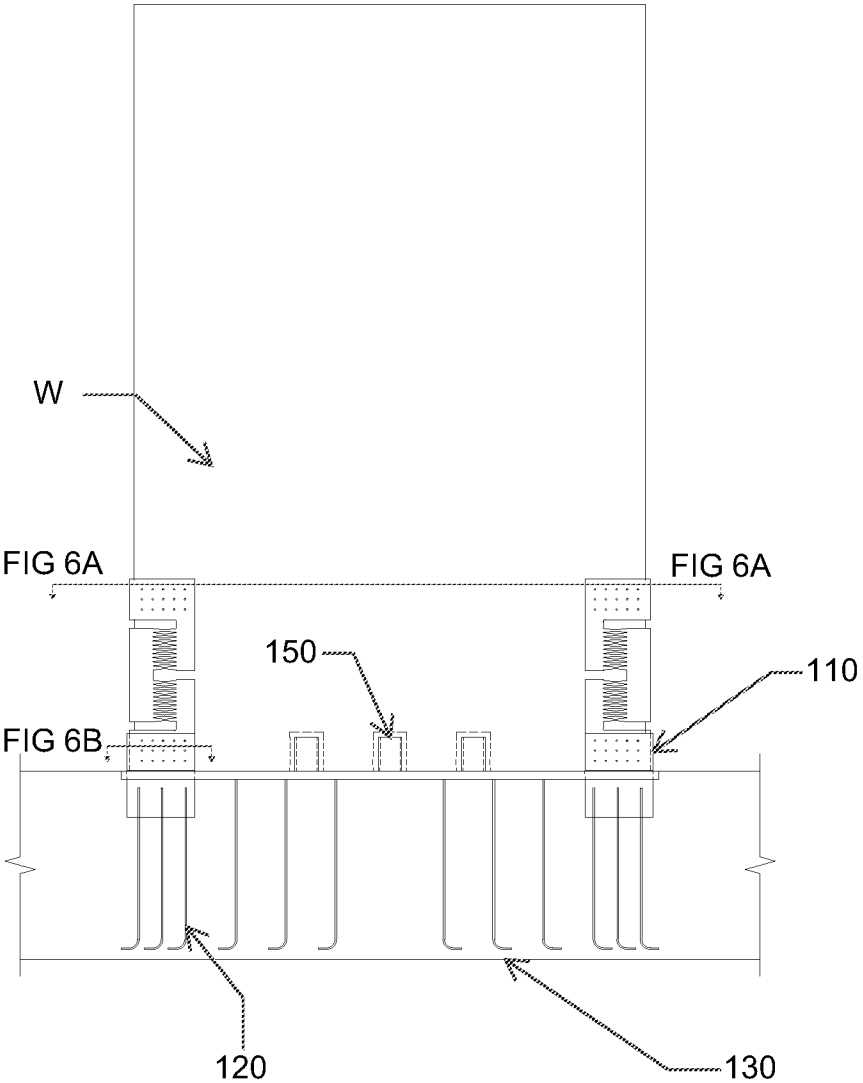
FIG. 7A is a front elevation view of the present system installed on opposite sides of a building wall, showing the system's linkage to a building foundation, prior to any seismic loading of the wall or deformation of the present seismic fuse's wall panels.

FIGS. 7A and 7B specifically illustrate the case of seismic loading in a shear direction in the plane of wall W. Note, this direction of loading is perpendicular to the "toppling" loading deformations described in the other Figures. As seen in FIG. 7A, foundation anchors 120 are received down into foundation 130. Foundation 130 may optionally be a concrete foundation and foundation anchors 120 may optionally be steel rebar. FIG. 7A illustrates the case of no seismic loading. FIG. 7B shows the case of seismic shear loading. As can be seen, a seismic wall fuse 10A (which may optionally comprise a nested pair of seismic wall fuses 10A and 10B similar to FIGS. 1 and 2) will expand (to the state/position shown in FIG. 5) whereas an opposite a seismic wall fuse 10B (which may also optionally comprise a nested pair of seismic wall fuses 10A and 10B similar to FIGS. 1 and 2) will be compressed (to the state/position shown in FIG. 4). In this particular case, wall panels 20 and 30 in seismic wall fuse 10A will be expanded together and wall panels 20 and 30 in seismic wall fuse 10B will be compressed together. As can be appreciated, therefore the present system can therefore resist seismic loading in both perpendicular directions (i.e.: the direction perpendicular to the wall that would otherwise topple the wall and in the shear direction in the plane of the wall). This feature of the present invention is very advantageous in that seismic loading is often in a direction that is at an oblique angle to the wall (i.e.: a direction that has components both parallel and perpendicular to the plane of the wall). Simply put, the present system can resist seismic loading in all directions.

Lastly, it is to be understood that the presently described and claimed invention is not limited solely to the embodiments described herein but also covers embodiments and variations within the scope of knowledge of a person skilled in the art.

What is claimed is:

1. A seismic wall fuse, comprising:

a first planar wall panel configured to be positioned flat against a wall, and a second planar wall panel configured to be positioned flat against the wall such that the first and second wall panels are parallel to one another, and wherein each of the first and second planar wall panels comprise:

a non-deformable top portion that is configured to be attached flat against the wall, a deformable mid portion that is configured to deform to absorb seismic stresses by deforming in a direction parallel to the plane of the wall, and a non-deformable bottom portion that is configured to be attached flat against the wall, wherein the non-deformable top portion is separated from the deformable mid portion by a first slot cut inwardly from a side edge of the wall panel, and wherein the non-deformable bottom portion is separated from the deformable mid portion by a second slot cut inwardly from a side edge of the wall panel.

2. The seismic wall fuse of claim 1, wherein:

the mid-portion of the first wall panel deforms to expand while the mid-portion of the second wall panel simultaneously deforms to contract, and the mid-portion of the first wall panel deforms to contract while the mid-portion of the second wall panel simultaneously deforms to expand.

3. The seismic wall fuse of claim 1, further comprising:

an edge panel connected on one side to the first wall panel and on another side to the second wall panel, wherein the edge panel is oriented perpendicular to the first and second wall panels such that the seismic wall fuse can be positioned to wrap around the edge of a wall.

4. The seismic wall fuse of claim 1, further comprising:

a plurality of wall connectors passing through the first and second wall panels to connect the first and second wall panels to opposite sides of a wall.

5. The seismic wall fuse of claim 4, wherein the first and second wall panels have apertures passing therethrough and wherein the apertures in the first and second wall panels are aligned such that the wall connectors pass through the aligned apertures in both the first and second wall panels.

6. The seismic wall fuse of claim 5, wherein the wall connectors are bolts.

7. The seismic wall fuse of claim 1, wherein the laterally extending slits are diamond shaped.

8. The seismic wall fuse of claim 1, wherein the wall panel deforms to absorb seismic stresses by:

widening the slots when the wall panel is stretched, and narrowing the slots when the wall panel is compressed.

9. The seismic wall fuse of claim 1, further comprising:

a third slot separating upper and lower regions of the mid-portion of the wall panel.

10. The seismic wall fuse of claim 9, wherein the first and second slots are cut inwardly in a first direction and the third slot is cut inwardly in a second direction, the first and second directions being opposite to one another.

11. The seismic wall fuse of claim 1, further comprising:

a wall, wherein the first and second wall panels are connected to opposite sides of the wall.

12. The seismic wall fuse of claim 11, wherein the wall is made of concrete.

13. The seismic wall fuse of claim 11, further comprising:

a base plate connected to the bottom of the wall; and a connection plate assembly connected both to the base plate and to the first and second wall panels.

14. The seismic wall fuse of claim 13, further comprising:

a plurality of foundation anchors connecting the base plate to a building foundation.

15. The seismic wall fuse of claim 13, further comprising:

a shear key connected to the base plate, wherein the shear key is receivable into an aperture in the wall.

16. The seismic wall fuse of claim 1, wherein a pair of the seismic wall fuses are nested together around the edge of a building wall.

17. The seismic wall fuse of claim 16, further comprising:

a connection plate assembly nested around the pair of seismic wall fuses.

18. The seismic wall fuse of claim 11, wherein the wall is made of:

wood, masonry, or cross-laminated timber.

* * * * *